US009369800B2

(12) United States Patent
Tan et al.

(10) Patent No.: US 9,369,800 B2
(45) Date of Patent: Jun. 14, 2016

(54) INTRINSICALLY SAFE AUDIO CIRCUIT FOR A PORTABLE TWO-WAY RADIO

(71) Applicant: MOTOROLA SOLUTIONS, INC, Schaumburg, IL (US)

(72) Inventors: Cheah Heng Tan, Bayan Lepas (MY); Friedrich J Bollmann, Birkenwerder (DE); Teik Seng Saw, Sungai Petani (MY); Peter William Hilding Svendsen, Virum (DK); Kheng Shiang Teh, Bayan Lepas (MY)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 187 days.

(21) Appl. No.: 14/037,900

(22) Filed: Sep. 26, 2013

(65) Prior Publication Data

US 2015/0086026 A1 Mar. 26, 2015

(51) Int. Cl.

| | |
|---|---|
| ***G03G 11/00*** | (2006.01) |
| ***H04R 3/00*** | (2006.01) |
| ***H04R 9/02*** | (2006.01) |

(52) U.S. Cl.

CPC ..... *H04R 3/007* (2013.01); *H04R 9/022* (2013.01); *H04R 2209/024* (2013.01); *H04R 2209/041* (2013.01)

(58) Field of Classification Search

CPC ..... H03F 3/2173; H03F 1/52; H03F 3/2171; H03F 3/187; H03F 3/68; H03F 1/0277; H03F 2200/321; H03F 2200/462; H03F 2200/537; H03F 2203/21157; H04R 3/007; H04R 9/02; H04R 3/00; H04R 3/04; H04R 29/001; H04R 3/08; H04R 9/06

USPC ..... 379/55, 300, 59, 89, 332, 111, 116, 379/117, 96, 401, 120, 121, 400, 402, 104, 379/107, 118, 182, 28, 412, 98, 123, 186, 379/335, 380, 397, 405, 407, 411, 57, 58, 379/61

See application file for complete search history.

(56) References Cited

U.S. PATENT DOCUMENTS

| | | | |
|---|---|---|---|
| 2,551,556 | A | 5/1951 | Brennan |
| 3,766,334 | A | 10/1973 | Burke |
| 4,360,707 | A | 11/1982 | Joseph et al. |
| 4,897,877 | A | 1/1990 | Tetzlaff |

(Continued)

FOREIGN PATENT DOCUMENTS

| | | | |
|---|---|---|---|
| EP | 1073312 | A2 | 1/2001 |
| GB | 406749 | A | 3/1934 |
| WO | WO2011068473 | A1 | 6/2011 |

OTHER PUBLICATIONS

GB Search Report Dated Mar. 18, 2015 for Counterpart Application GB1416814.0.

*Primary Examiner* — Akelaw Teshale

(74) *Attorney, Agent, or Firm* — Scott M. Garrett; Barbara R. Doutre

(57) ABSTRACT

An intrinsically safe audio circuit and intrinsically safe portable two-way radio device meet conventional audio output requirements and intrinsically safe design limitations by separating the speaker coil of the device's speaker into separate coils to limit the energy storage possible in any one of the coils. Each separate coil is driven by one of several different audio power amplifiers that each output a substantially identical signal, and each of which are current limited.

21 Claims, 6 Drawing Sheets

(56) References Cited

U.S. PATENT DOCUMENTS

| | | | | |
|---|---|---|---|---|
| 5,212,732 | A | 5/1993 | Hipps et al. | |
| 6,148,088 | A | 11/2000 | Suzuki et al. | |
| 7,194,104 | B2 | 3/2007 | Sahyoun | |
| 8,325,943 | B2 | 12/2012 | Button et al. | |
| 8,385,580 | B2 | 2/2013 | Adamson | |
| 2004/0196987 | A1 | 10/2004 | Sahyoun | |
| 2005/0078848 | A1* | 4/2005 | Hlibowicki | H03F 3/2171 381/401 |
| 2007/0041606 | A1 | 2/2007 | Sheppard | |
| 2007/0127766 | A1 | 6/2007 | Combest | |
| 2007/0297639 | A1 | 12/2007 | Noll | |
| 2008/0025551 | A1 | 1/2008 | Wehner | |
| 2009/0067643 | A1* | 3/2009 | Ding | H04R 3/002 381/96 |
| 2010/0271994 | A1* | 10/2010 | Wolfe | H04W 52/0264 370/311 |
| 2012/0020479 | A1 | 1/2012 | Zhang | |
| 2012/0230518 | A1 | 9/2012 | Siek | |
| 2012/0329409 | A1 | 12/2012 | Chauhan et al. | |
| 2013/0108100 | A1 | 5/2013 | Alvarez Ibarra | |

* cited by examiner

INTRINSICALLY SAFE AUDIO CIRCUIT FOR A PORTABLE TWO-WAY RADIO

FIELD OF THE DISCLOSURE

The present disclosure relates generally to portable two-way radio devices and more particularly to portable two-way radio devices that are operated in the presence of volatile gasses and are designed in a manner to prevent ignition of volatile gasses such that the portable two-way radio device is considered intrinsically safe.

BACKGROUND

A portable two-way radio device is a hand-held device that the user carries on the user's person, such as in a holster or other carrier, and the user can operate the portable two-way radio by, for example, manipulating buttons and knobs on the radio, or by using a remote accessory also worn by the user that is connected to the portable two-way radio device. Portable two-way radios are used in a wide variety of applications where instant or near-instant communication is desirable. Two-way communication systems, including portable two-way radio devices, are used by public safety, emergency, rescue, fire, and industrial organizations, among others. Generally, two-way communication is a half-duplex type of communication where the radio device is either receiving, transmitting, or in standby/monitoring mode when on. When a user "keys up" a two-way radio, the radio will typically check to make sure the channel is clear and then begin transmitting after giving an audible indication to the user indicating the radio is transmitting and the user can commence speaking. The radio continues to transmit as long as the user has the radio keyed. To key the radio the user can press a "push to talk" button on the radio, or a remote radio microphone accessory, if used.

In some situations, the user of a portable two-way radio device may carry the radio, knowingly or unknowingly, into places where there are volatile gasses in the surrounding air. Examples of such places including mining operations, industrial and chemical settings, accident scenes, and so on. Given that portable two-way radio devices are battery powered, and contain various components that store energy in addition to the battery (e.g. capacitors, inductors), the potential exists for a discharge event or localized heat generation that can cause ignition of surrounding volatile gasses. To address such conditions manufacturers have taken measures to design portable two-way radio devices that are classified as being intrinsically safe for use by personnel who could operate in such conditions. To be rated as intrinsically safe, among other limitations, a battery powered electronic device must be designed to limit energy storage in the circuit components in case a fault occurs that releases the energy stored in those components, and precautions must be taken to limit energy available at the battery terminals to prevent sufficiently energetic sparks in case an inadvertent shorting between the terminals occurs. Furthermore, power provided to the device or components in the device from the battery may need to be limited in order to prevent thermal heating of small components to avoid creating a heat source sufficient to cause ignition of volatile gasses, dust, or other such compounds in the surrounding atmosphere.

The typical storage components in a given electronic device are capacitors and inductors. Capacitors store energy in the form of electrical charge and inductors store energy in the form of a magnetic field resulting from current through the inductor. Most of these passive components are small in typical electronic devices, including two-way radios, and will not store sufficient energy to be of concern, even when summed together under the assumption of an extreme fault condition. However, power handling components can have capacitance or inductance values large enough to be of concern, and may need to be limited.

In portable two-way radio devices, audio volume is particularly important since the user must be able to hear communications under potentially noisy conditions. The need for audio volume sufficient for the user to hear received audio over ambient sounds necessitates the use of speakers to play received audio signals. Speakers suitable for portable two-way radio applications typically use an inductive speaker coil that is driven by the audio amplifier. In an intrinsically safe application, however, the inductance of the speaker coil has to be limited to prevent exceeding energy storage specifications as well as avoiding excessive temperatures. Limiting the speaker coil inductance, though, limits the audio volume that can be achieved.

Accordingly, there is a need for an apparatus for achieving a desired audio volume without exceeding specified energy storage and temperature limits in an audio circuit of a device designed for intrinsically safe applications.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
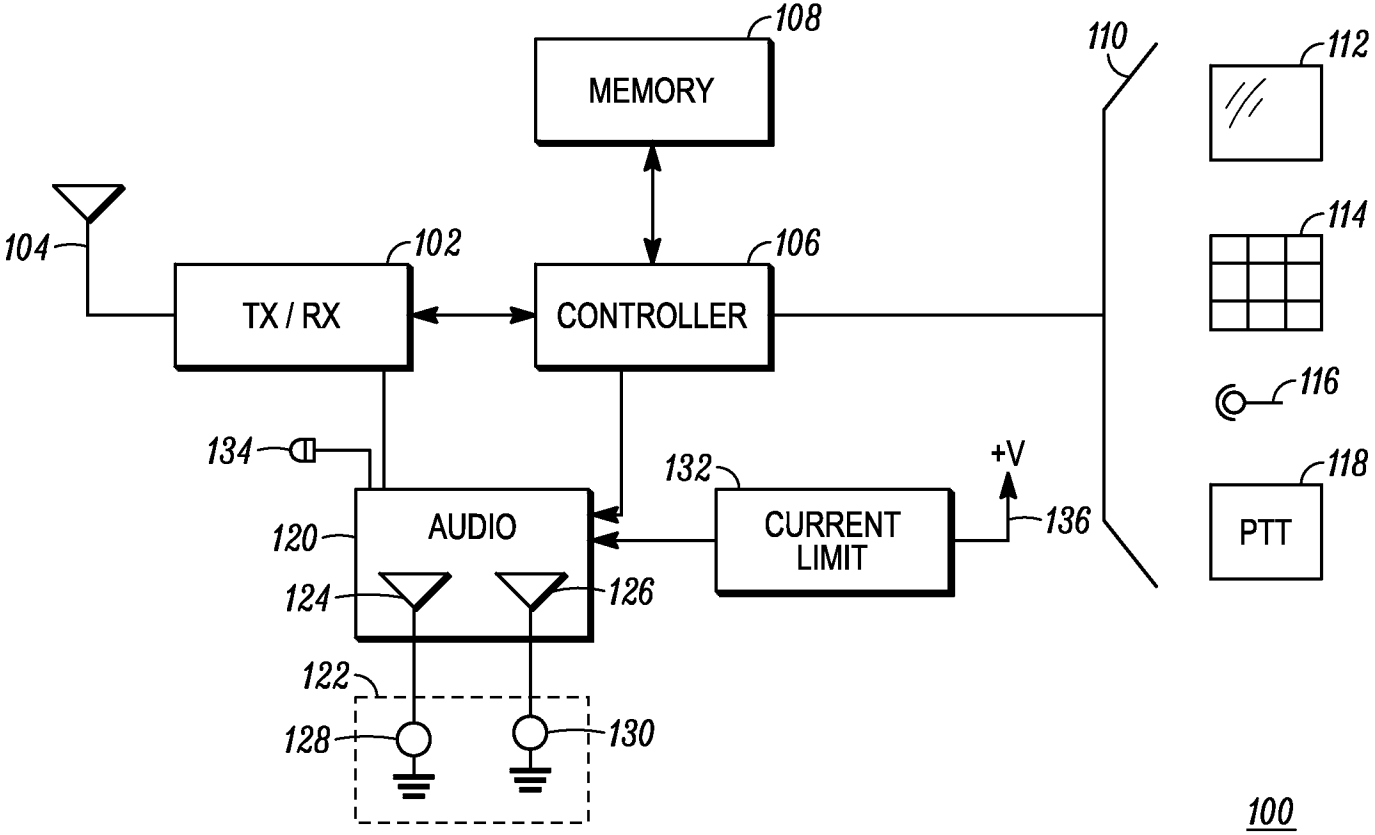
FIG. 1 is a block diagram of a portable two-way radio device in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

There is provided herein an audio circuit for a portable two-way radio device comprising: an audio power amplifier circuit having an input that is common to a first audio power amplifier and a second audio power amplifier, the first audio power amplifier providing a first output and the second audio power amplifier providing a second output; a first set of series-connected redundant current limiters coupled to a power input of the first audio power amplifier, and a second set of series-connected redundant current limiters coupled a power input of the second audio power amplifier, wherein each of the current limiters limit the electrical current provided to its respective amplifier from a power source to a preselected current level based on an ignition safety level of electrical current; and a speaker including a first speaker coil connected to the first output of the audio power amplifier circuit, and a second speaker coil connected to the second output of the audio power amplifier circuit, each speaker coil having an inductance value that is selected based on the preselected current level to be incapable of storing energy in excess of a preselected energy storage limit that is based on an ignition safety level of energy storage, wherein the first and second speaker coils are separated from each other by a preselected minimum dielectric distance based on a minimum safe voltage rating.

FIG. 1 is a block diagram of a portable two-way radio device 100 in accordance with some embodiments. In particular, the portable two-way radio device 100 is designed to meet intrinsically safe standards so that it can be used safely in the presence of volatile gasses or other airborne matter that could be ignited. As such, great care is taken in the design, layout, and component selection for circuitry and construction of the portable two-way radio device 100 to meet intrinsically safe design standards so as to eliminate, intrinsically, the potential for either unsafe energy storage that could cause spark ignition, or power dissipation that causes component heating to a degree that could cause thermal ignition. Intrinsically safe standards are specified by various agencies such as, for example, the European Directive for Equipment for use in Explosive Atmospheres (ATEX), and the International Electrotechnical Commission for Certification to Standards Relating to Equipment for use in Explosive Atmospheres (IECEx), to name a few.

The portable two-way radio device 100 includes a transceiver 102. The transceiver 102 includes both a radio transmitter and a radio receiver that are coupled to an antenna 104 for transmitting and receiving radio signals. The transceiver 102, although it may contain a processor such as a digital signal processor, operates under control of a controller 106 that is responsible for the general operation of the portable two-way radio device 100. The controller 106 can be a microprocessor or microcontroller that executes instruction code designed to cause the portable two-way radio device 100 to operate according to a design specification. The instruction code can be instantiated in a memory 108 that can include random access memory (RAM). The memory 108 can represent an aggregation of memory types including RAM, read only memory (ROM), and other types of memory such as reprogrammable non-volatile memory such as flash memory. To enable operation of the portable two-way radio device 100, the controller 106 is further coupled to several user interface elements 110, which can include a graphical display 112, a keypad and other buttons and knobs 114, an accessory connector 116, and a push to talk (PTT) button 118. The graphical display 112 can present textual and graphical material for visual display to a user. The keypad, buttons, and knobs 114 allow a user to input information, including selections of menu elements presented on the graphical display 112, as well as well as to select operational settings such as, for example, channel selection, audio volume, and so on.

As the main purpose of the portable two-way radio device 100 is for voice communication, it also includes an audio section or circuit 120 that processes audio signals received by the transceiver 102, and plays the received audio signals over one or more speakers in a speaker assembly 122. The audio section 120 can receive audio signals in acoustic form, from the user, via a microphone 134 which converts incident acoustic signals into electrical signals, as is known. Since the portable two-way radio device 100 is designed to be intrinsically safe, the inductance of any speaker coil must be small enough to avoid storing sufficient energy to cause a spark ignition if a fault occurred at peak current. Furthermore, intrinsically safe standards require a safety factor to ensure that even under extreme fault conditions the energy storage of a component will be limited to a safe level. Accordingly, the inductance value that is allowed under intrinsically safe standards is significantly smaller than the theoretical limit. The intrinsic safety limitation on the maximum inductance value limits the power that can be provided to a speaker coil, thus limiting the audio power and therefore the audio volume (e.g. sound pressure level). Given that it can be critical to hear voice communications, and that a user may be located in a noisy environment, it is desirable to provide a particular level of audio volume that may not be achievable using a conventional speaker with a speaker coil limited to the maximum allowable inductance under intrinsically safe standards.

To overcome the limitation resulting from inductance limits the speaker assembly 122 includes multiple speaker coils 128, 130, which are each driven by a separate audio power amplifier 124, 126, respectively. The total number of windings for the plurality of speaker coils 128, 130 can be substantially equal to that of a conventional speaker that produces the desired sound pressure level, but does not need to conform to intrinsically safe standards because the total inductance of a conventional speaker coil allows energy storage in excess of that allowed by intrinsically safe standards. The speaker coils 128, 130 can be disposed in a single speaker, or the speaker assembly 122 can include multiple speakers, each having one (or more) speaker coils, with each speaker coil being coupled to the output of a different audio power amplifier. The audio power amplifiers are individually current limited by redundant current limiters in a current limit block 132 which limit the current that can be drawn from a battery source 136. Each audio power amplifier 124, 126 draws current through a pair of series-connected redundant current limiters in the current limit block 132 that have fast response so that they limit current to the limited value even in the event of a fault (e.g. "short circuit," or an interruption or open circuit) at the output of either of the amplifiers 124, 126. That is, the response time of the current limiters is such that the current through them cannot reach a spark ignition energy level. The current limit value can be set to a thermal ignition limit based on the direct current (DC) resistance of the speaker coil. That thermal ignition limit, with appropriate safety margin, can determine the inductance value of the speaker coil in view of an energy storage limit for spark ignition.

Figure 2:
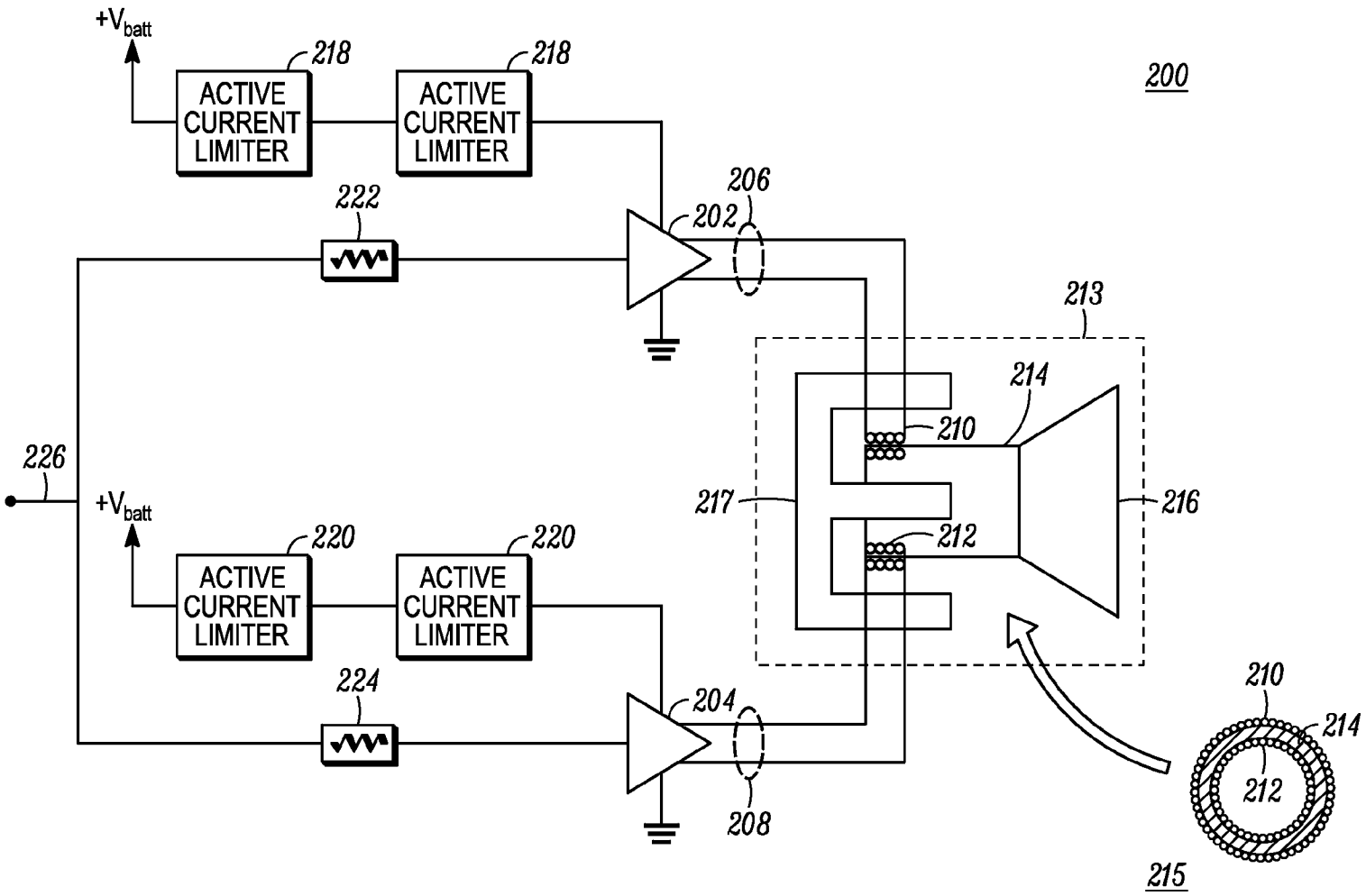
FIG. 2 is a block diagram of an audio circuit in accordance with some embodiments.

FIG. 2 is a block diagram of an audio circuit 200 in accordance with some embodiments. The audio circuit 200 can represent embodiments such as, for example, audio section 120 and current limiters 132 of FIG. 1. The audio circuit 200 includes a first audio power amplifier 202 and a second audio power amplifier 204. The first audio power amplifier 202 provides a first output 206 and the second audio power amplifier 204 provides a second output 208. The first output 206 is coupled to a first speaker coil 210 and the second output 208 is coupled to a second speaker coil 212. In the embodiments represented here the first speaker coil 210 encircles the second speaker coil 212 and first and second speaker coils 210, 212 are separated by a bobbin or speaker coil former 214. View 215 represent a top sectional view of the first and second speaker coils 210, 212 and speaker coil former 214 showing that they are arranged in a substantially circular arrangement (and can also be oval). The first speaker coil 210 is wound around the outside circumference of the speaker coil former 214 and the second speaker coil 212 is wound around the inside circumference of the speaker coil former 214. As shown here, the speaker coil former 214 provides the separation between the first and second speaker coils 210, 212. The speaker coils 210, 212 must be separated to an intrinsically safe standard. Typically, that means they are separated by a prescribed dielectric distance, meaning a distance, based on the dielectric material separating the speaker coils 210, 212 that can withstand a standardized voltage differential without breaking down. In some standards the dielectric distance is based on a 500 volt differential. Accordingly, using the 500 volt standard, the portion of the speaker coil former 214 that separates the first and second speaker coils 210, 212 must be able to withstand a 500 volt DC differential between the first and second speaker coils 210, 212. Depending on the material used for the speaker coil former 214, the thickness of the speaker coil former can be, for example, 0.5 millimeters. The speaker coil former 214 locates the speaker coils 210, 212 in the magnetic field of a permanent magnet 217 of the speaker assembly 213. As the audio power amplifiers 202, 204 drive their respective speaker coils 210, 212 the resulting magnetic field produced by the speaker coils 210, 212 interacting with the static magnetic field produced by the permanent magnet 217 causes the speaker former 214 to move in correspondence with the signal output by the audio power amplifiers 202, 204 to the speaker coils 210, 212. The speaker former 214 can be coupled or integrally formed with a speaker cone or membrane 216. The speaker membrane 216 will be supported by a speaker support structure (not shown), as is well known.

In order to prevent excessive current from reaching the speaker coils 210, 212, the audio power amplifiers 202, 204 are each supplied from the battery (+Vbatt) through a pair of series-connected current limiting circuits 218, 220, respectively. Thus, there are two current limiting circuits 218, 220 between each audio power amplifier 202, 204 and the battery. The current limiting circuits 218, 220 can be active current limiters that act quickly in the event of a fault, where the response time is on the order of microseconds. The current limiters can completely shut off current in response to an excessive load, such as a fault or short circuit in the audio power amplifiers 202, 204 or at the outputs 206, 208 of the audio power amplifiers 202, 204. Each of the redundant current limiters 218, 220 is set to a current limit at a level based on the DC resistance of the speaker coils 210, 212 and the maximum battery voltage (+Vbatt) for thermal ignition consideration.

Each of the audio power amplifiers 202, 204 receive the same input signal that is provided to a common input 226. The signal provided to the common input 226 can be provided by a receiver, such as a receiver in a transceiver 102 of FIG. 1. Thus, each audio power amplifier 202, 204 is amplifying substantially the same signal. A passive barrier 222, 224 is provided between each audio power amplifier 202, 204 and the common input 226. The passive barriers 222, 224 can be a resistance, and provide a current barrier in case of a fault condition. Since the audio power amplifiers 202, 204 have a high input impedance the passive barriers 222, 224 do not substantially affect signal propagation from the common input 226 to the audio power amplifiers 202, 204.

Figure 3:
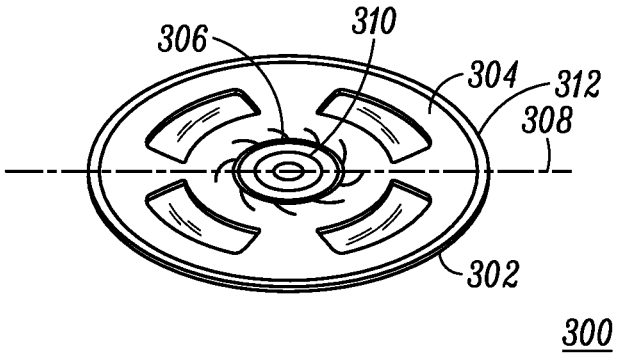
FIG. 3 is an isometric view of a speaker having multiple, separate speaker coils in accordance with some embodiments.

FIG. 3 is an isometric view of a speaker 300 having multiple, separate speaker coils in accordance with some embodiments. The speaker 300 is suitable for use in a portable two-way radio device. Generally, the speaker 300 is circular, but can be oval shaped, as is known, and comprises a body or support structure 302 over which a cone or membrane 304 is mounted that is attached to the support structure 302 at an edge 312 around the speaker 300. The membrane 304, as shown here, is transparent, and moves in correspondence with an audio signal to produce an acoustic signal or waveform. The membrane 304 can have an annular speaker coil former 306 integrally formed on the membrane 304 and which protrudes into a gap between magnetic elements 310. Two speaker coils are disposed on the speaker coil former 306, and are used to drive the membrane to create the acoustic signal. Dashed line 308 is a cut line through which the speaker 300 is cut to create the view of FIG. 4.

Figure 4:
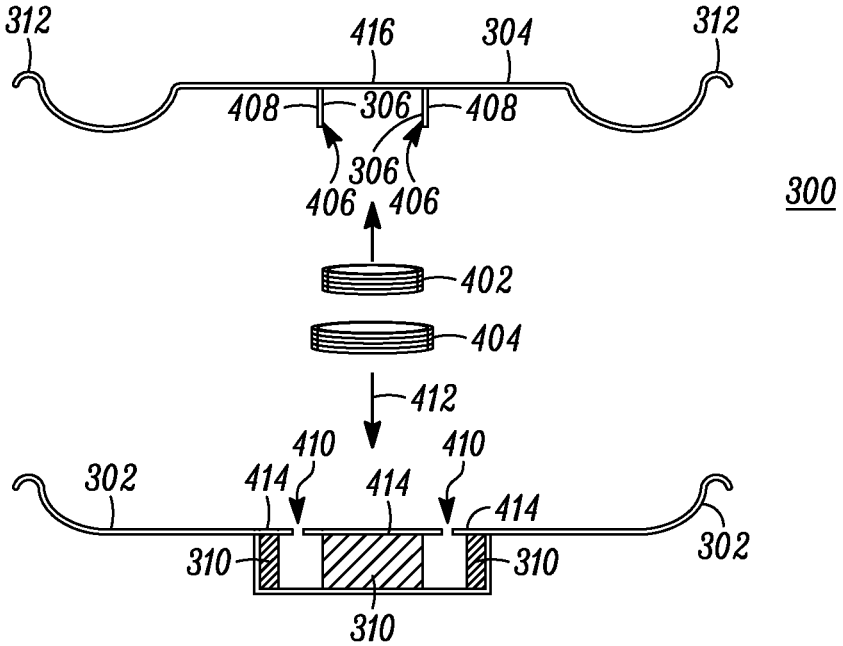
FIG. 4 is a cutaway sectional exploded view of a speaker having multiple, separate speaker coils in accordance with some embodiments.

FIG. 4 is a cross sectional exploded view of a speaker 300 having multiple, separate speaker coils 402, 404 in accordance with some embodiments. The view in FIG. 4 represent a cross sectional view of the speaker 300 along line 308 in FIG. 3. The membrane 304 is mounted on the speaker support structure 302, and includes an annular speaker coil former 306 having an inside 406 and an outside 408. A first speaker coil 402 can be mounted on the inside 406 of the speaker coil former 306 and a second speaker coil 404 can be mounted on the outside 408 of the speaker coil former 306. Each of the speaker coils 402, 404 are connected to a different, separate audio power amplifier, as indicated, for example, in FIG. 2. The speaker coils 402, 404, upon being mounted on the speaker coil former 306 as indicated, can be placed in a gap 410 in the support structure 302 as indicated by arrow 412. The gap 410 focuses a static magnetic field from one or more permanent magnets 310 using pole pieces 414. The pole pieces 414 are ferromagnetic members placed in contact of close proximity to the permanent magnets 310. Thus, as current through the speaker coils 402, 404 changes, the resulting time-varying magnetic field interacts with the magnetic field produced by the permanent magnets 310, focused by the pole pieces 414, causing the membrane 304 to move correspondingly and create an acoustic signal. In particular, the membrane 304 is a flexible material, and the center portion 416 of the membrane, where the speaker coil former 306 is located, moves (up and down, as oriented in FIG. 4) while the edge 312 of the membrane 304 is attached to the support structure 302.

Figure 5:
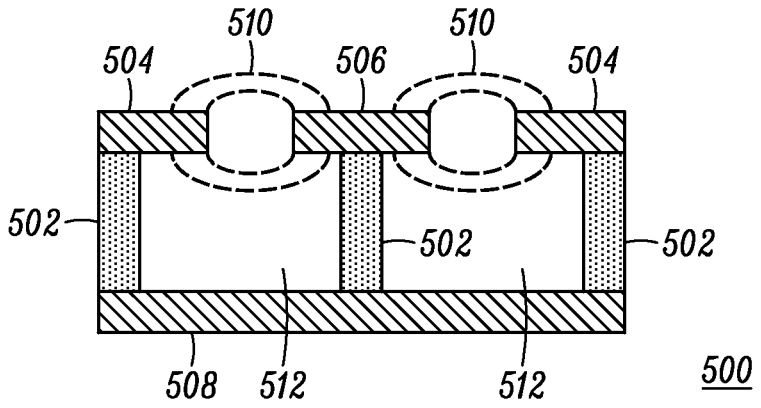
FIG. 5 is a side cutaway view of a speaker magnet and pole assembly in accordance with some embodiments.
Figure 6:
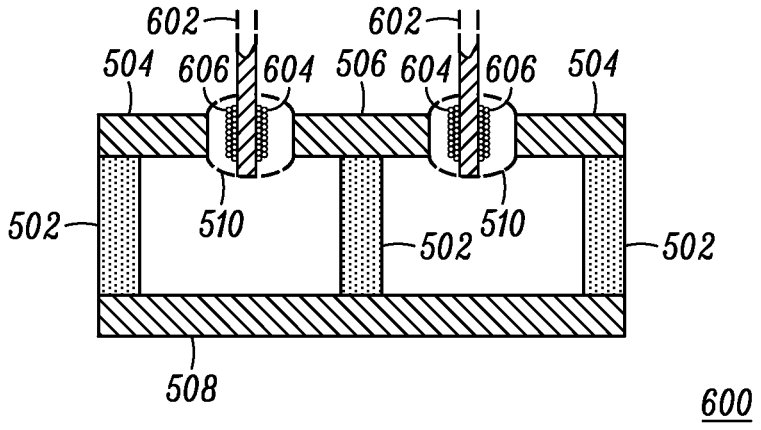
FIG. 6 is a side cutaway view of a speaker magnet and pole assembly in which multiple separate speaker coils of the speaker are disposed in accordance with some embodiments.

FIG. 5 is a cross sectional view of a speaker magnet and pole assembly 500 in accordance with some embodiments. The view shown here in FIG. 5 is a more detailed view of a cross section of a speaker as shown, for example, in FIG. 4. The assembly 500 includes permanent magnets 502 and pole pieces 504, 506. The pole pieces create a magnetic field 510 in the space 512 between the pole pieces 504, 506. The magnets 502 are supported on a substrate 508 that can be the same material as the pole pieces 504, 506. FIG. 6 is a cross sectional view of a speaker magnet and pole assembly 600 in which multiple separate speaker coils of the speaker are disposed in accordance with some embodiments. The assembly 600 is identical to assembly 500 of FIG. 5, but includes a speaker coil former 602 and speaker coils 604, 606. The speaker coil former 602 is attached to, or formed integrally with a speaker cone or membrane (not shown). A first speaker coil 604 is disposed on an inside surface of the speaker coil former 602 and a second speaker coil is disposed on an outside surface of the speaker coil former 602. As such, one speaker coil encircles the other, they are concentric and coaxial, and a substantially identical signal is applied to both of them by separate audio power amplifiers. They also have the same orientation so their respective magnetic fields add together to effectively double the force with which the speaker membrane can be driven, thus doubling the acoustic volume that can be produced by the speaker over a single speaker coil that is limited in inductance and current by intrinsically safe standards.

Figure 7:
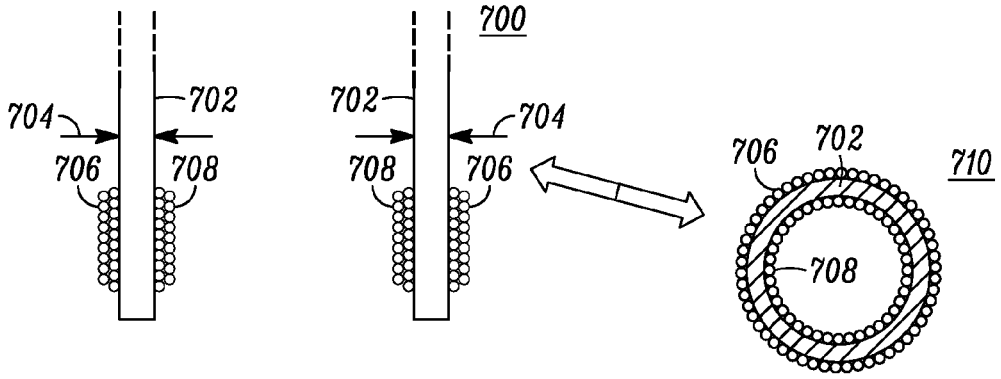
FIG. 7 is a side cutaway view of an arrangement of multiple, separate speaker coils in accordance with some embodiments.

FIG. 7 is a side cutaway view of an arrangement 700 of multiple, separate speaker coils in accordance with some embodiments. The arrangement 700 can be similar to that shown in FIGS. 5-6. A speaker coil former 702 is integrally formed with, or attached to a speaker membrane (not shown). A first speaker coil 706 is disposed around the outside of the speaker coil former 702 and a second speaker coil 708 is disposed around the inside of the speaker coil former 702. View 710 shows a top (or bottom) view of speaker coil former 702, with the first speaker coil 706 and second speaker coil 708 disposed around the outside and inside, respectively, of the speaker coil former 702. To meet intrinsically safe standards, the speaker coils 706, 708 must be separated by a prescribed distance that depends, in part, on the dielectric constant of the material or matter separating the speaker coils 706, 708. Here, the separation between the first and second speaker coils 706, 708 is provided by the thickness 704 of the speaker coil former 702. The material that is used to create the speaker coil former 702 can be a dielectric material, and in some embodiments can allow as little as 0.5 millimeter separation and meet intrinsically safe standards.

Figure 8:
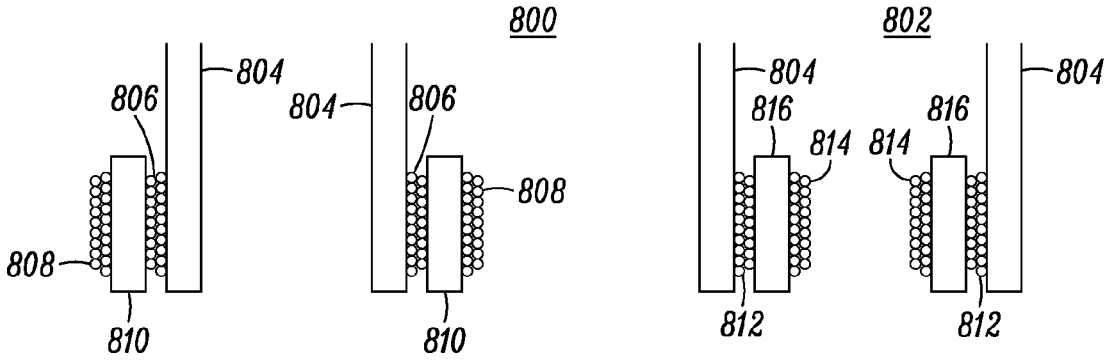
FIG. 8 is a side cutaway view of an arrangement of multiple, separate speaker coils in accordance with some embodiments.

FIG. 8 shows a first arrangement 800 and a second arrangement 802 by side cut away views of multiple, separate speaker coils in accordance with some embodiments. In each arrangement 800, 802 there are first and second speaker coil pairs 806, 808 and 812, 814 disposed around a portion of a speaker coil former 804. In arrangement 800 the first and second speaker coils 806, 808 are disposed about the outside of the speaker coil former 804, and in arrangement 802 the first and second speaker coils 812, 814 are disposed around the inside of the speaker coil former 804. In the first arrangement 800 the first and second speaker coils 806, 808 are separated by a first separator 810, and in the second arrangement 802 the first and second speaker coils 812, 814 are separated by a second separator 816. In both arrangements 800, 802, the speaker coils are concentric and collocated in substantially the same plane, and on the same side of the speaker coil former 804. The first and second separators 810, 816 have to separate the first and second speaker coil pairs 806, 808 and 812, 814, respectively, by a distance that satisfies intrinsically safe standards, both in thickness and width. Each speaker coil 806, 808, 812, 814 is driven by a separate audio power amplifier, and each pair is oriented so that their respective magnetic fields complement each other to increase the force exerted on the speaker coil former 804, and therefore on the speaker membrane (not shown) over that which is possible with a single speaker coil that meets intrinsically safe standards. Each speaker coil 806, 808, 812, 814 must be designed to meet intrinsically safe standards, which includes limiting the energy in each speaker coil. The energy storage can be limited by limiting the current through each coil as well as by limiting the inductance of each coil. Generally, limiting the energy to less than 40 microjoules, including applicable safety factors, will meet intrinsically safe standards. The inductance value of each speaker coil and the current limit will depend on factors including the available voltage and the thermal ignition (i.e. ignition from heating of the coil or other components under fault conditions) considerations.

Figure 9:
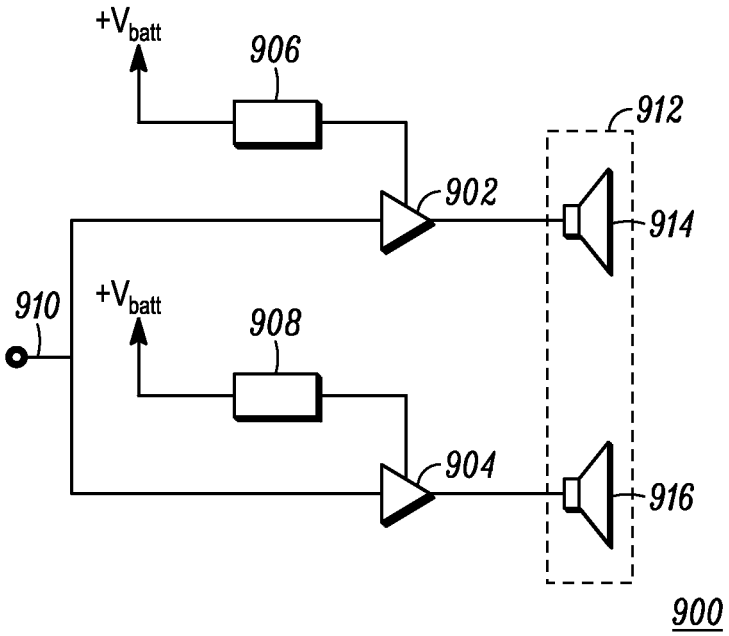
FIG. 9 is a block diagram of an audio circuit using multiple speakers in accordance with some embodiments.

FIG. 9 is a block diagram of an audio circuit 900 using multiple speakers in accordance with some embodiments. In FIGS. 2, 4, and 6-8 the speaker coils are disposed about a speaker coil former that drives a single speaker. In some embodiments the speaker coils can be separated by being disposed in separate speakers. A speaker assembly 912 includes a first speaker 914 and a second speaker 916. Each of the speakers 914, 916 have a single speaker coil. The first speaker 914 is driven by a first audio power amplifier 902 and the second speaker is driven by a second audio power amplifier 904. Each of the audio power amplifiers 902, 904 are supplied from a power source (+Vbatt) through a respective current limiting block 906, 908, each of which includes redundant limiting circuits as prescribed by intrinsically safe standards. Thus, rather than using two or more speaker coils to drive one speaker in order to increase the audio volume generated by a speaker assembly for a portable two-way radio device, in some embodiments it is contemplated that two (or more) speakers can be used where each speaker is driven by a substantially identical signal 910, where each speaker is designed and limited to meet intrinsically safe standards for spark and thermal ignition.

Figure 10:
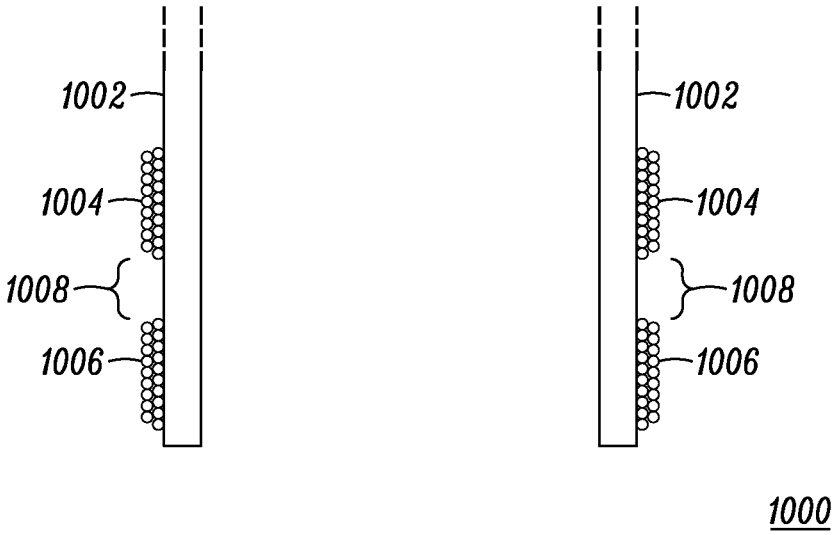
FIG. 10 is a side cutaway view of a speaker coil arrangement in accordance with some embodiments.

FIG. 10 is a side cutaway view of a speaker coil arrangement 1000 in accordance with some embodiments. In the present arrangement, rather than arranging the speaker coils concentrically, they are arranged non-concentrically, but still coaxially on a speaker coil former 1002. Accordingly, first and second speaker coils 1004, 1006 are both disposed on the same side of the speaker coil former 1002, and are separated by a distance 1008 to maintain an intrinsically safe distance between the speaker coils 1004, 1006. As shown here the speaker coils 1004, 1006 are both disposed on the outside of the speaker coil former 1002, but those skilled in the art will realize that the speaker coils 1004, 1006 could equivalently be disposed on the inside of the speaker coil former 1004, or staggered with one on the inside and one on the outside.

Accordingly, the arrangements and audio circuits exemplified herein provide the benefit of increasing the audio volume capable of being generated by a speaker under intrinsically safe design limitations by providing a second speaker coil that is likewise subject to the same intrinsically safe design limitations. Additional speaker coils can be added to meet desired acoustic sound pressure levels. Each speaker coil is driven with a substantially identical signal from a separate audio power amplifier. The benefit is particularly useful for intrinsically safe portable two-way radio devices where it is necessary to meet audio volume levels that allow users to hear voice communication clearly over ambient noise, which may be significant. Using a single speaker coil that meets intrinsically safe standards may not produce a sufficient audio volume for a portable two-way radio device. In fact, the total number of windings between the multiple speaker coils used in the various embodiments may be equivalent to a standard number of windings for a given speaker. By separating the total number of windings into separate coils, each driven by a dedicated separate audio power amplifier that is redundantly current limited, substantially the same audio performance can be achieved under intrinsically safe design limitations as using one coil with an equivalent number of windings where meeting intrinsically safe standards is not necessary.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An audio circuit for a portable two-way radio device, comprising:

an audio power amplifier circuit having an input that is common to a first audio power amplifier and a second audio power amplifier, the first audio power amplifier providing a first output and the second audio power amplifier providing a second output;

a first set of series-connected redundant current limiters coupled to a power input of the first audio power amplifier, and a second set of series-connected redundant current limiters coupled a power input of the second audio power amplifier, wherein each of the current limiters limit the electrical current provided to its respective amplifier from a power source to a preselected current level based on an ignition safety level of electrical current; and a speaker including a first speaker coil connected to the first output of the audio power amplifier circuit, and a second speaker coil connected to the second output of the audio power amplifier circuit, each speaker coil having an inductance value that is selected based on the preselected current level to be incapable of storing energy in excess of a preselected energy storage limit that is based on an ignition safety level of energy storage, wherein the first and second speaker coils are separated from each other by a preselected minimum dielectric distance based on a minimum safe voltage rating.

2. The audio circuit of claim 1, wherein the first and second speaker coils are arranged concentrically with respect to each other, wherein the first speaker coil encircles the second speaker coil, and the first and second speaker coils are separated by a dielectric material.

3. The audio circuit of claim 2, wherein the dielectric material comprises an annular portion of a speaker membrane of the audio speaker on which the first and second speaker coils are disposed, and wherein the annular portion projects perpendicularly from a surface of the speaker membrane.

4. The audio circuit of claim 2, wherein the first and second speaker coils are separated by at least 0.5 mm.

5. The audio circuit of claim 3, wherein the first and second speaker coils are mounted on a same side of the annular portion and are separated by an annular separator member.

6. The audio circuit of claim 1, wherein the preselected energy storage limit is 40 microjoules.

7. An audio circuit for a portable two-way radio, comprising:

an audio speaker having a membrane with a speaker coil formed on the membrane;

a first speaker coil and a second speaker coil, each disposed about the speaker coil former, and wherein the first speaker coil and second speaker coil are physically separated from each other by a preselected minimum dielectric distance based on a minimum safe voltage rating; and a first audio power amplifier providing a first input coupled to a battery source and a first output coupled to the first speaker coil and a second audio power amplifier providing a second input coupled to the battery power source and a second output coupled to the second speaker coil, wherein each of the first and second inputs are current limited based on an ignition safety level of electrical current and so as to limit an energy storage in each of the first and second speaker coils below a preselected energy storage limit that is based on an ignition safety level of energy storage, and wherein each of the first and second outputs provide a common audio signal to the first and second speaker coils.

8. The audio circuit of claim 7, wherein the first and second speaker coils are arranged concentrically with respect to each other, wherein the first speaker coil encircles the second speaker coil, and the first and second speaker coils are separated by a dielectric material.

9. The audio circuit of claim 8, wherein the dielectric material comprises an annular portion that projects perpendicularly from a surface of the speaker membrane.

10. The audio circuit of claim 8, wherein the first and second speaker coils are separated by at least 0.5 mm.

11. The audio circuit of claim 9, wherein the first and second speaker coils are mounted on a same side of the annular portion and are separated by an annular separator member.

12. The audio circuit of claim 7, wherein the preselected energy storage limit is 40 microjoules.

13. A portable two-way radio, comprising:

a transceiver over which an audio signal is received;

an amplifier circuit including a first audio power amplifier and a second audio power amplifier, each of which amplify the audio signal in common, the first audio power amplifier providing a first output and the second audio power amplifier providing a second output;

a speaker assembly including a first speaker coil coupled to the first output and a second speaker coil coupled to the second output; and a first redundant current limiter that limits current from a battery power source to the first audio power amplifier to a first current limit and a second redundant current limiter that limits current from the battery power source to the second audio power amplifier to a second current limit, the first and second current limits being set for an ignition safety level of electrical current;

wherein the first and second speaker coils each have an inductance value such that each of the first and second speaker coils store less than an ignition safety level of energy storage of 40 microjoules at the first and second current limits, respectively.

14. The portable two-way radio of claim 13, wherein the first speaker coil is disposed in a first speaker, and the second speaker coil is disposed in a second speaker.

15. The portable two-way radio of claim 13, wherein the first and second speaker coils are disposed in the same audio speaker and are arranged concentrically with respect to each other, wherein the first speaker coil encircles the second speaker coil, and the first and second speaker coils are separated by a dielectric material.

16. The portable two-way radio of claim 15, wherein the dielectric material comprises an annular portion of a speaker membrane of the audio speaker on which the first and second speaker coils are disposed, and wherein the annular portion projects perpendicularly from a surface of the speaker membrane.

17. The portable two-way radio of claim 15, wherein the first and second speaker coils are separated by at least 0.5 mm.

18. The portable two-way radio of claim 16, wherein the first and second speaker coils are mounted on a same side of the annular portion and are separated by an annular separator member.

19. The portable two-way radio of claim 18, wherein the annular portion separates the first and second speaker coils.

20. The audio circuit of claim 1, wherein the power source is a battery power source, and the first set of series-connected redundant current limiters are coupled between the battery power source and the power input of the first audio power amplifier, and the second set of series-connected redundant current limiters are coupled between the battery power source and the power input of the second audio power amplifier.

21. The audio circuit of claim 1, wherein the current limit value is set to a thermal ignition limit based on a direct current (DC) resistance of the speaker coil.

* * * * *